United States Patent [19]

Blatt

[11] Patent Number: 5,026,174

[45] Date of Patent: Jun. 25, 1991

[54] PLASTIC FILM BAG WITH SPECIAL FLAP ARRANGEMENT

[75] Inventor: Eli Blatt, Brookville, N.Y.

[73] Assignee: Ultra Creative Corporation, Brooklyn, N.Y.

[21] Appl. No.: 390,157

[22] Filed: Aug. 7, 1989

Related U.S. Application Data

[63] Continuation of Ser. No. 163,297, Mar. 1, 1988.

[51] Int. Cl.[5] ..... B65D 33/34

[52] U.S. Cl. ..... 383/86; 383/87; 383/121; 204/168

[58] Field of Search ..... 383/67, 84, 86, 86.1, 383/86.2, 87, 121, 122; 229/76, 77, 79; 204/168

[56] References Cited

U.S. PATENT DOCUMENTS

| | | | |
|---|---|---|---|
| 2,400,406 | 5/1946 | Godoy | 229/79 |
| 3,348,762 | 10/1967 | Kasinkas | 383/86 X |
| 3,670,947 | 6/1972 | Tangredi et al. | 383/87 X |
| 4,153,560 | 5/1979 | Dinter et al. | 204/168 X |
| 4,298,440 | 11/1981 | Hood | 204/168 X |
| 4,502,599 | 3/1985 | Perecman | 383/86 X |

FOREIGN PATENT DOCUMENTS 2345355 3/1976 France .

*Primary Examiner*—Stephen Marcus
*Assistant Examiner*—Nova Stucker
*Attorney, Agent, or Firm*—Ladas & Parry

[57] ABSTRACT

A polyethylene or polypropylene bag is provided with a two-section flap. The sections are spaced by a gap, but are connected by Scotch tape which bridges the gap. Part of the adhesive on the tape is exposed through the gap and provides an adhesive strip for the sealing, opening and resealing of the flap. The bag is provided with an ink-receptive characteristic, except in correspondence with the adhesive strip, to assure retention of the adhesive on the tape. The bag can be provided with a mouth closed by the flap and with the opposite end open so that goods can be inserted through the open end and later accessed via the mouth when the flap is opened.

11 Claims, 6 Drawing Sheets

PLASTIC FILM BAG WITH SPECIAL FLAP ARRANGEMENT

This is a continuation on application Ser. No. 163,297 filed Mar. 1, 1988.

FIELD OF INVENTION

This invention relates to plastic film bags and, more particularly, to plastic film bags having special flap arrangements.

BACKGROUND

Many provisions have been heretofore proposed with regard to the development of plastic film bags manufactured, for example, of film strips of polyethylene or the like. Some developments have been shown for bags and envelopes in general in U.S. Pat. Nos. 2,066,495; 2,131,575; 2,330,666; 2,991,001; 3,026,018; 3,203,621; 3,670,947; 3,990,627; and 4,415,087.

W. E. Swift in U.S. Pat. No. 2,066,495 reveals an envelope having correspondingly shaped areas of its seal flap and body coated with a dry- sealing adhesive. An apertured portion of the envelope body is disposed between the adhesive areas to maintain the adhesive areas out of engagement. Sealing of the envelope is effected by pressing portions of the adhesive areas into contact through the apertured portion. In this arrangement, the flap is fabricated of a monolithic piece provided with the aforesaid apertures and there is further provided a cooperating adhesive on the envelope itself, which cooperating adhesive along with the first noted adhesive is of such a character that it will adhere upon non-moistened contact to the other adhesive, although it will not adhere to the material of which the envelope is made.

C. R. Whipple in U.S. Pat. No. 2,131,575 reveals an envelope which includes a pocket and a flap for closing the pocket which normally overlies a part of the rear wall of the envelope. Adjacent faces on the flap and on the rear wall of the envelope have complementary areas coated with an adhesive of the type which will adhere to itself upon the application of pressure alone, but will not adhere to the uncoated parts. The adhesive coating on at least one of the parts has uncoated areas adjacent to the coated areas which are disposed out of the normal plane of the coated areas for normally maintaining the coated areas on the two parts in spaced relation. The coated areas on the respective parts are adapted to be brought into adhering relation by the application of pressure to the overlying coated areas.

In U.S. Pat. No. 2,330,666, E. B. Berkowitz reveals a quick opening envelope formed of fibrous material including a body portion and a seal flap portion extending along an opening in said body portion through which contents of the envelope may be emptied. A gum repellent coating on one of the portions is provided, contacting the other portion when the seal flap portion is in sealed position. The portion provided with the gum repellent coating has restricted uncoated sealing spaces within the coated area. Gum between the portions for effecting seals at the restricted spaces is provided. Substantially arcuate cutting edges are provided by the coating on sides of the sealing space nearest the opening for severing any fibers which are embedded in the gum when the flap portion is pulled loose while opening the envelope.

W. L. Hughes in U.S. Pat. No. 2,991,001 discloses a resealable container. This container has a body portion and an entrance at one end of the same. A resealing arrangement is provided which overlies a peripheral resealing path defined by perforations in the container. Further included is a tear strip adjacent the exterior of the resealing path and protruding into the container. A pressure-sensitive tape overlies the tear strip and the resealing path. The tear strip is disengageable from the tape to tear and remove the resealing path and thus expose pressure sensitive portions of the tape for mutual adhesion and resealing of the container.

E. Stratton reveals in U.S. Pat. No. 3,026,018 envelopes having gummed flaps formed with tape. More particularly, an envelope is provided which includes a front and a back joined at their peripheral edges to form an envelope pocket. A flap is hinged to the front along a fold line. This flap is swingable above the fold line to close the envelope pocket. Longitudinally projecting portions formed integrally with the bag and positioned at opposite ends of the fold line are provided. The longitudinally projecting portions extend across the lines of fold between the front and the flap, and are in adhering relationship to the flap in order to strengthen the envelope at the opposite ends of the line of fold.

D. Wright in U.S. Pat. No. 3,203,621 reveals a bag-top closure made of paper, folded along a crease to form two panels. Each of these panels has a substantial portion of its inside surface coated with an adhesive composition such as, for example, water-soluble adhesive compositions and heat sensitive thermoplastic adhesive compositions. The adhesive coating on one of the panels is rendered ineffective except for a small area by a patterned application of a superimposed coating of a permanent masking agent. In this arrangement, an attached tab depends from the bottom edge of the masked panel and employs an adherent coating of a pressure-sensitive adhesive composition.

A hanger bag with a flap closure is shown by A. Tangredi et al in U.S. Pat. No. 3,670,947. This hanger bag is formed from a single, elongated sheet of flexible thermoplastic film by cutting a series of spaced- apart notches in one of the longitudinal edges of the film. The distance between the notches is the desired width of the finished bag. The opposite longitudinal end of the sheet is doubled back to the desired height of the finished bag. The notched edge is folded over the opposite edge and a hanger or handle member is heat sealed to the upper folded-over edge between the spaced-apart notches. Thereafter there is effected the step of heat sealing and severing the folded film transversely, with the heat seal passing through the notch whereby a finished bag is formed. This arrangement employs a pressure sensitive tape to keep the flap secured. The flap is itself in the form of a monolithic structure.

In U.S. Pat. No. 3,990,627, R. Olson discloses an adhesive closure for bags, including an adhesive stripe located adjacent the open mouth portion of the bag. The adhesive stripe is covered until ready for use by the upper portion of the bag's front wall whereby upward displacement of the front wall exposes the adhesive stripe for sealing the upper portion of the bag walls together.

W. Clayton et al reveal in U.S. Pat. No. 4,415,087 an improved adhesive system for forming resealable channel closures for flexible bags. The adhesive system includes a layer of hot metal adhesive over which a thin second layer of a liquid-based adhesive such as a water-based pressure sensitive acrylate is applied.

None of the aforegoing patents reveal the provision of a flap portion consisting of two entirely separate sections, separated by a gap which is bridged by a tape bearing thereupon a pressure-responsive adhesive as will be discussed in further detail hereinbelow.

SUMMARY OF INVENTION

It is an object of the invention to provide an improved flap arrangement for closeable bags or envelopes made, for example, of plastic films.

It is another object of the invention to provide improved bags having flap portions especially designed to be manufactured by mass production techniques in an improved manner.

Still another object of the invention is to provide an improved envelope or bag manufactured, for example, of plastic film having improved sealing arrangements incorporated into the flap portion thereof.

Still another object of the invention is to provide an improved bag or envelope structure having an improved flap portion which is readily manufactured and which is simple to employ during closing and opening operations which are performed relative to the bag.

Still another object of the invention is to provide an improved flap portion wherein a gap between two sections and exposing an adhesive is of a breadth which is easily varied in the manufacturing process.

In achieving the above and other objects of the invention, there is provided in accordance therewith an article of manufacture including a bag or envelope (these terms are used interchangeably herein) provided with a mouth with a first flap section on the bag at the mouth to close the same and with an arrangement on the first flap section and extending beyond the same and including an adhesive to bond to the bag. Additionally, there is provided a second flap section in extension of, but separated from, the first flap section, these sections defining a gap therebetween. The aforesaid arrangement spans this gap and attaches the second section to the first section.

The above-noted arrangement in accordance with the invention includes a tape, such as Scotch tape, having one face on which the adhesive is supported; this tape bridges the gap and is bonded by the adhesive to the flap sections. The gap and tape are of at least substantially constant respective breadths with the breadth of the tape being substantially greater than the breadth of the gap whereby to be able to bridge the same and to adhere to appropriate portions of the respective flap sections. The bag and flap sections are preferably of a plastic film and the tape is of a substrate bearing preferably a pressure-responsive adhesive thereon.

As will be seen, the bag is preferably formed of two sheets of plastic in face-to-face relation and perimetrally bonded at least except at the aforesaid mouth. It is also possible to make the bag of a single sheet of plastic which is folded over in order to form thereby two plastic film sections in face-to-face relationship which are also perimetrally bonded. In one form, it is possible to leave the bottom of the bag open in order to provide for a bottom filling of the same, whereafter the bottom is sealed to retain the contents therein. Thereafter the bag can be used by opening the opposite end or flap end for releasing the substance or material or other such article of manufacture from the bag.

In the aforesaid arrangement, the first-mentioned section is hingedly connected to one of the sheets and the flap sections are preferably and conjointly arranged to have trapezoidal configurations. The trapezoidal section of the first flap portion is further provided with a rectangular base section which is hingedly connected to the bag body. The sections of the flap are in substantially coplanar relationship.

In further accordance with the invention, the second flap section includes indicia thereon to distinguish the second flap section and indicate to a user where the flap sections and adhesive arrangement can be lifted from the bag body.

According to another feature of the invention, the tape is of a trapezoidal configuration corresponding to a portion of that of the flap sections upon which the tape is superposed. The flap sections are at least in part interposed between the tape and the bag body except at the gap.

According to yet another feature of the invention, the film has generally an ink receptive surface except for a portion corresponding to, but exceeding, the breadth of the adhesive exposed through the aforesaid gap.

It is a further object of the invention to provide an improved bag in the form of an article of manufacture which is readily loaded in a unique manner and which provides for facilitating access to the goods which may be inserted into bags of the improved construction.

In accordance with this aspect of the invention, there is provided a bag having a pocket for the internal accommodation of goods and having an end which is initially closed, but which is adapted for being opened to provide access to the goods after the goods are loaded into the bag. The bag furthermore includes a zone spaced from the aforenoted end and which is open for the loading of the goods, but which is closeable and therefore adapted for being closed after the goods are loaded into the bag.

The bag in this sense includes a flap hingably connected on the aforesaid end to enable closing the same. The above-mentioned zone is a second end opposite the first mentioned end, and the bag is preferably made, as noted above, of plastic films in face-to-face relation. The bag, moreover, is of a material adapted for being closed by heat sealing at the aforenoted zone.

The above and other objects, features and advantages of the invention will be found in the detailed description which follows hereinbelow as illustrated in the accompanying drawing.

BRIEF DESCRIPTION OF DRAWINGS

In the drawing:

FIG. 1(*a*) is a fragmentary cross-sectional view of said tape;

DETAILED DESCRIPTION

Figure 1:
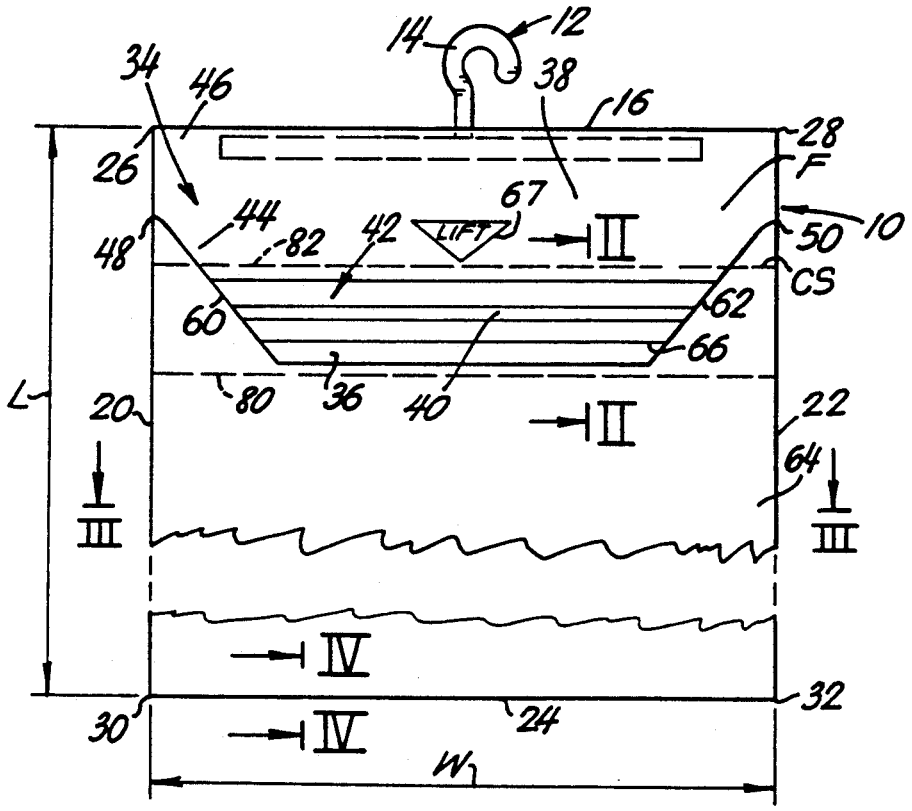
FIG. 1 is a partially broken away view of one face of a bag or envelope provided in accordance with the invention and including a flap portion configured as two separate sections connected together by a tape.

FIG. 1 of the drawing illustrates an envelope or bag 10 provided at the top thereof with a hanger indicated generally at 12. The hanger is not a basic feature of the invention and may be provided in any conventional form. It may be provided by passing the hanger handle 14 through a slot (not shown) at the upper edge or end 16 of the bag 10 as disclosed in U.S. Pat. No. 3,429,498 which issued to J. Dorfman on Feb. 25, 1969, or it may be, for example, provided by being attached by a seal as shown in U.S. Pat. No. 3,670,947 which issued Jun. 20, 1972 to A. Tangredi et al.

The bag (or envelope) has an interior pocket in which may be accommodated typically software items, such as pajamas, blouses and shirts or the like, which are displayed through the transparent material of which the bag is made. The bag 10 is, for example, made of a flexible material, such as plastic film and, more particularly, polyethylene or polypropylene film having a thickness of, for example, from about 0.0005 to 0.020 inches. The aforegoing materials are mentioned by way of example only as the envelopes or bags of the invention may be fabricated from other materials both natural and synthetic and including such materials as paper, cloth, and so on which are preferably plasticized and shape-retentive to the extent which will be apparent from the following description.

As has been noted above, the bag 10 has a top end or edge 16. This edge is constituted usually by a fold line, the material from which the bag is constructed being doubled over at this edge or end. The bag, furthermore, has lateral edges 20 and 22, and a bottom end or edge 24. The lateral edges 20 and 22 are preferably seal lines which are formed during the continuous manufacture of a series of bags. Before sealing, there are adjacent bags attached along edges 20 and 22. Sealing as well as severance takes place in a conventional manner during the process to be described hereinunder. The width of the bag is indicated at W. This width may be selected according to need, and is easily and readily adjusted in the manufacturing process. A portion of the bag is broken away to show also that the length or height of the bag indicated at L is also easily varied during the manufacturing process.

As is apparent from the drawing, the bag is of rectangular configuration in the preferred embodiment. It therefore has four corners as indicated at 26, 28, 30 and 32. The bag also includes a flap portion 34 which has a construction constituting an important feature of the invention. First of all, it will be noted that the flap portion 34 consists of two flap sections 36 and 38, which are physically separated from one another by a gap 40 which is bridged by a tape indicated at 42. Gap 40 has a breadth G, bridged by said tape, preferably in the range of from 0.030 to 1.00 inches. This dimension can be outside of the given range according to need.

The flap section 36 has a trapezoidal configuration. The flap portion or section 38 has a downwardly located section or part 44 which is likewise of trapezoidal configuration, this trapezoidally configured part being connected to an upper section 46 which may be regarded generally as having a rectangular configuration extending between lateral edges 20 and 22 and connected to fold line 16. Trapezoidal section 44 is monolithic with rectangular section 46 as indicated at points 48 and 50. The edges of flap portion 34 between points 26 and 48 and points 28 and 50 are sealed respectively to edges 20 and 22.

Figure 1A:
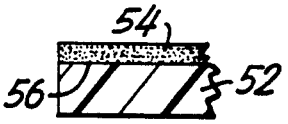

The tape 42 which will be discussed in greater detail hereinbelow, is preferably a Scotch tape of commercially available type. Such a tape as illustrated in FIG. 1*a* consists of a substrate 52 atop of which is located a pressure-responsive adhesive 54. The surface of the substrate 52 which is coated is indicated at 56 and, in accordance with the invention, the adhesive is preferably applied to only one face, as illustrated. Pressure-responsive adhesives and suitable substrates such as cellophane, plastic, and the like are commercially available and well known for application in the invention. However, it should be noted that the substrate 52 of the tape to be applied to flap portions of bags of the invention adds somethickness to the flap portion at gap 40 and forms a compositematerial which is generally more shape-retentive than the plastic film of which such bags are manufactured. The softness and pliability of the bag material nevertheless allow ready conformation to the objects which are to be packaged in such bags, whereas the shape-retentive quality added by the Scotch tape enables reinforcing the bag material where the tape is applied. This avoids puckering during and after the manufacture of the bag to facilitate sealing, opening and resealing of the mouth of the bag body located at the fold line 16.

Figure 2:
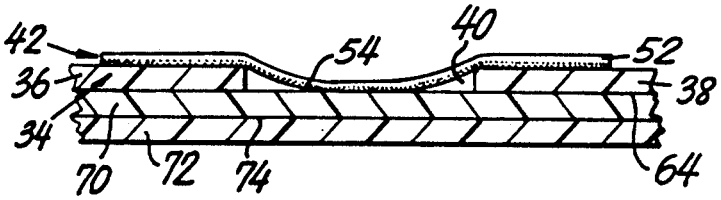
FIG. 2 is a cross-sectional view taken along line II—II of FIG. 1.

It will be noted that the tape 42 is trimmed at 60 and 62, thereby giving the tape a trapezoidal configuration conforming to that of adjacent portions of the flap portions 36 and 38. It will also be noted that the tape extends entirely across the flap portion at the portion to which the tape is connected. In FIG. 2 and in accordance with the invention, the tape is superposed on the flap portion 34 with the adhesive 54 being exposed downwardly through the gap 40 and thereby constituting an adhesive strip which is employed for sealing the flap portion against the upper surface of the bag as indicated at 64.

A printed triangle is indicated at 66 this triangle is provided by application of a printing ink. Within this triangle is indicated a legend, such as LIFT or LIFT TO OPEN or some other such text which will indicate to the user of the bag the precise area in which the seal exists. Thus the flap portion or section 36 constitutes a well identified, readily liftable section hingeable at the bottom extremity 66 of gap 40, thereby facilitating initiation of the lifting of the flap portion whereby the bag may be opened.

FIG. 2, noted above, illustrates a broken away portion of the bag of FIG. 1 in section and somewhat diagrammatically. In FIG. 2 appears the tape 42 with substrate 52 to which adheres the pressure-responsive adhesive 54. The gap is, once again, indicated at 40 and in this figure appear the two layers or film sections 70 and 72 with line 74 indicating the pocket of the bag within which may be stored suitable objects such as mentioned above. The flap portion is, again, indicated at 34 with its sections 36 and 38. The adhesive is exposed through the gap 40 and is applicable, as noted hereinabove, to the surface 64 of film section 70 to be able to adhere to the same and to provide for a temporary seal thereby bonding the flap portion 34 temporarily to the surface 64.

In general, the outer surfaces of the film from which the bag is manufactured are treated, for example, as indicated in U.S. Pat. No. 3,348,762 (Kasinkas) to form an oxidized strip. This has two effects. One effect is to make the treated surfaces more ink-receptive, thereby to permit and facilitate a printing of text material and art work on the bags so treated. The oxidation is formed by a process in which a gap voltage, generated in the air between an electrode and the bag, ionizes the ambient air proximate to the bag. The ionized ozone thus formed acts as an oxidizing agent and the oxidized surface has the desired ink receptive characteristics.

In accordance with the invention, it is preferred that a strip corresponding to but exceeding the gap 40 and the pressure-responsive adhesive exposed therethrough be relieved of such ink receptive characteristic, as it has been found that this prevents the adhesive on the substrate from being more or less permanently bonded to the surface 64, thereby to be undesirably removed from the tape 42. To this end, there is provided during the pretreatment, a strip or area CS whose limits are indicated at 80 and 82. This portion is devoid of oxidation and ink receptive characteristics and thereby lacks the characteristics causing it to bond more permanently to the exposed adhesive of the tape 42. This greatly facilitates the opening and closing of the flap portion 34 and allows the adhesive 54 (see FIG. 1*a*), to adhere permanently to substrate 52 whereby opening and closing of the flap portion are permitted in repetitive fashion.

Figure 3:
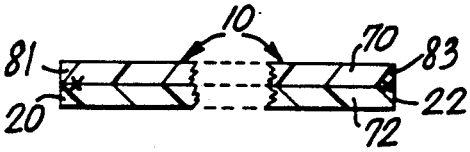
FIG. 3 is a cross-sectional taken along line III—III of FIG. 1.

FIG. 3 is a cross section of the bag taken along line (III—III) of FIG. 1. This figure illustrates the film sections 70 and 72 and furthermore illustrates at 81 and 83 the sealing which is affected at the lateral edges 20 and 22 of the bag 10.

Figure 4:
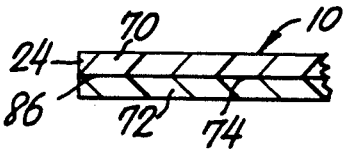
FIG. 4 is a cross-sectional view taken along line IV—IV of FIG. 1.

FIG. 4 is a cross sectional view taken along line IV—IV of FIG. 1. The figure also illustrates film sections 70 and 72 as well as bottom edge 24 of bag 10. In this embodiment of the invention, the pocket 74 is open and there is no seal provided in zone 86. This means that the bottom edge 24 of the bag 10 is open and that an insertion of objects into such bags may be effected from the bottom end, which is thereafter sealed in any conventional manner.

Figure 5:
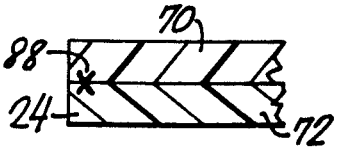
FIG. 5 is a cross-sectional view corresponding to FIG. 4, illustrating a further embodiment of the invention.

FIG. 5 illustrates a variation of the aforegoing embodiment in which layers 70 and 72 are sealed, as indicated at 88, to close off the bottom edge 24. This sealing may take place subsequent to the existence of the structure as illustrated in FIG. 4, but may alternatively be effected during the manufacturing process. This closure may, in fact, be simply a fold-over operation by which the bottom edge of the bag 10 is closed. In this case, insertion of objects into the bags must take place from the mouth at the tops of the bags, according to another embodiment of the invention.

As pointed out by W. Clayton in U.S. Pat. No. 4,415,087, bags with adhesive closures advantageously are adjustable to the size of the object contained therein. Clayton, however, points out that it has been difficult to find a satisfactory adhesive which is suitable for use with recloseable plastic bags such as those made from polyethylene and polypropylene film. U.S. Pat. No. 4,415,087 points out that an adhesive which adheres adequately to a polyethylene surface may form a seal that is not easily reopenable without destruction of the closure or a portion of the bag, while an adhesive that forms a resealable closure may not adhere sufficiently to a base film or closure strip.

U.S. Pat. No. 4,414,087 further points out that attempts at finding adhesives suitable for use in constructing resealable closures for flexible bags have involved certain problems including that the adhesives are not easily applied at high speeds without need of a drying step. Moreover, the strength of the adhesives may be reduced during processing, which is also unsatifactory.

Another problem pointed out is that many adhesives, which have been tried, did not form a satisfactory bond to polyethylene film or the like. These adhesives may be removed during the opening of the bag, leading to a deterioration of the related seals after a number of openings and resealings. Bags formed in accordance with the instant invention, however, avoid these problems. The adhesive adheres permanently to the substrate from which the adhesive is not detached during repeated openings and closings of the flap portions of the bags of the invention. This result can, moreover, be enhanced by clearing away a portion of the ink receptive surface as noted above. Moreover, the tape substrate adds to the shape-retentive characteristics of the adjacent flap portions, thereby preventing puckering and other such deformations.

Figure 6:
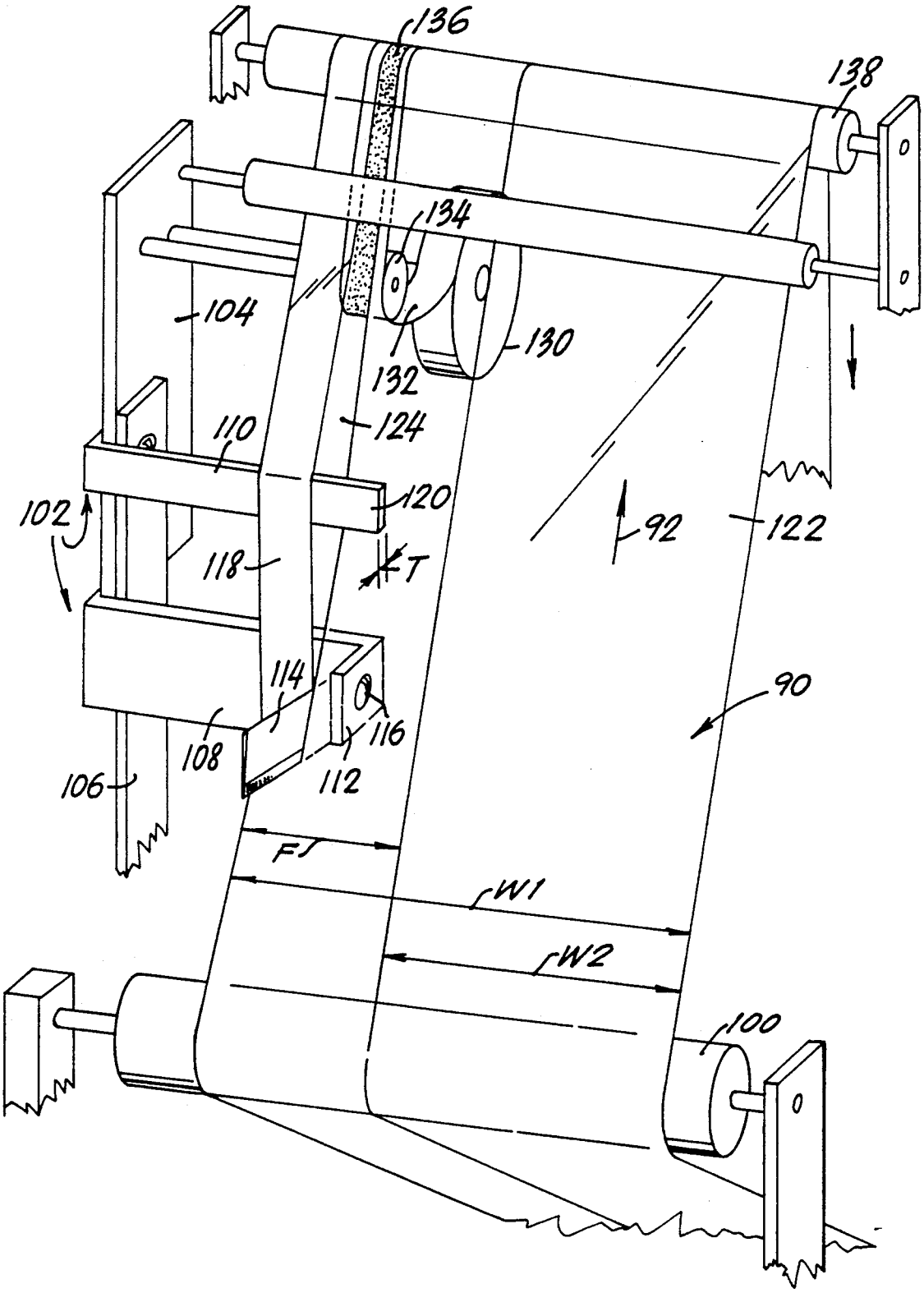
FIG. 6 is a perspective view of an apparatus for separating a flap portion into separate sections with a gap therebetween and for applying an adhesive tape thereto.

The remainder of the figures of the drawings illustrate the apparatus and method by means of which bags of the invention can be produced. In the apparatus and methods of the invention there is employed the continuous feeding of one or more strips of polyethylene or polypropylene or the like, thereby to effect mass production techniques. In FIG. 6, for example, is illustrated a continuously moving asrrangement of a strip or a plurality of face-to-face strips indicated at 90 and longitudinally displaceable in the direction indicated by arrow 92. The strip arrangement is indicated with two widths W1 and W2. Width W2 indicates the height L of the film section 70 previously discussed relative to FIGS. 1-5. Width W1 indicates the height L plus an amount necessary to form a flap. Bag sections 70 and 72 may be provided as separate film sections provided from separate sources (not shown). Alternatively, film sections 70 and 72 may be provided from a single film which is folded over to provide a partial overlap with the additional section having a breadth indicated at F in FIG. 6 and constituting the flap portion 34 ultimately to be formed, as indicated in FIG. 1.

The film strip arrangement 90 passes, for example, over a roller indicated at 100. This roller may be an idling roller which is not positively driven other than by the passage of the film strip arrangement thereover. At least one of the rollers, however, arranged along the path of travel 92 of the film strip arrangement is positively driven, so that the film strip arrangement 90 is held under tension free of undulations, puckers, folds or the like and with a speed consistant with the notching or cutting or sealing to be mentioned hereinbelow.

At 102 in FIG. 6 is indicated a cutting and bearing thereon a support beam 106 to which is affixed an angle 108. An angle 110 is also affixed between the support beam 106 and the fixed base 104. To the outer flange 112 of the angle 108 is affixed a slicing tool such as a razor blade or the like. The razor blade is indicated at 114 and is affixed to the flange 112 by a fastening member such as screw or nut and bolt arrangement as indicated at 116. The slicing tool 114 is arranged to make an incision to sever away a portion indicated at 118. This portion is the portion from which flap section 36 will ultimately be formed, as will be described hereinbelow. The portion 118, which remains connected to the film strip arrangement 90 upstream of the slicing tool 114, is passed around a spacer element indicated at 120. The purpose of this spacer element is to displace the portion 118 from the main body 120 of the film strip arrangement 90 by a gap 124 which corresponds to the gap 40 in FIG. 1. This gap is retained, as is the relative position of the portion 118, by the tension under which the film strip arrangement 90 is placed by having one or more positively driven rollers to displace the film strip arrangement 90 along its path of processing.

The width of the gap 124 may be controlled by the thickness T of the spacer element 120 and by the angle of insertion thereof in the gap 124. Both the slicing tool 114 and the spacing tool 120 are shown by way of illustration only and various other types of tools made of various materials such as metal or the like are clearly useful to serve the respective objects of these tools in accordance with the invention.

At 130 is indicated a source of Scotch tape or other equivalent tape having a suitable substrate with a pressure-responsive adhesive or the like positioned preferably on only one face thereof. The continuous tape is indicated at 132 and is guided into contact with the film strip portions 118 and 122 by a guide roller 134. The adhesive on the tape 132 is brought into engagement and bonds to the film strip arrangement with a part of the adhesive being exposed upwardly, as indicated at 136, to constitute the exposed adhesive which will ultimately be used for the repetitive sealing of the resultant bags. The aggregate thus formed is passed over a guide roller 138 thereafter proceeding to the station indicated in FIGS. 7 and 8.

Figure 7:
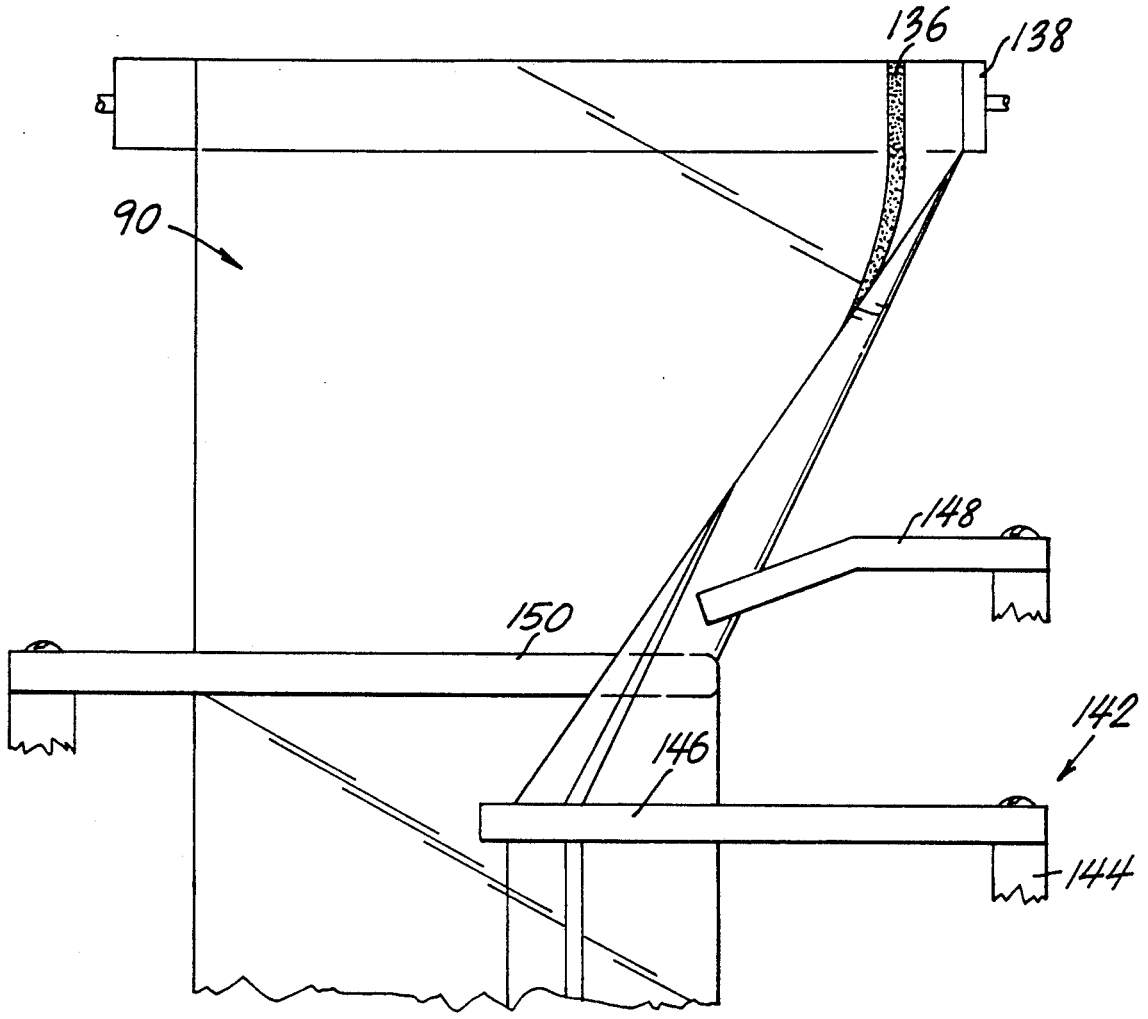
FIG. 7 is a view showing a continuation of the apparatus of FIG. 6, with provisions being made for folding over the flap portion of the film being processed.
Figure 8:
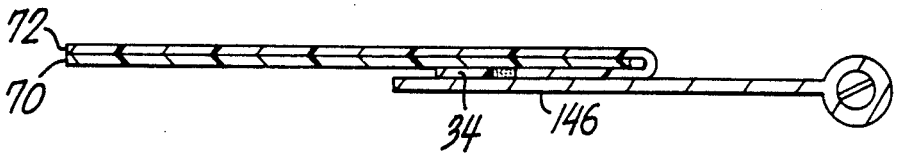
FIG. 8 is an enlarged view, partially in section, showing a detail of the apparatus of FIG. 7.

In FIGS. 7 and 8 the film strip arrangement 90, including exposed adhesive strip 136, is shown as passing over a guide roller 138 over which the film strip arrangement 90 passes on its way to folding station 142. The folding station 142 consists of a support 144 bearing a folding tool 146. This folding tool also includes an arm 148 for guiding the folding over of the flap and an arm 150 placed therefrom and inserted under the flap. In the setting up process, the film strip is taken from the roller 140 by manual manipulation and is folded over and brought between tool section 150 and a roller 152. The flap portion F is thereby folded over, thereby giving rise to portions 34, 70 and 72 as has been previously discussed relative to FIGS. 1-5. The thusly formed arrangement then proceeds to the cutting station illustrated in FIG. 9, with the flap section F or 34 bonded by adhesive 136 to the film sheet or section 70.

Figure 9:
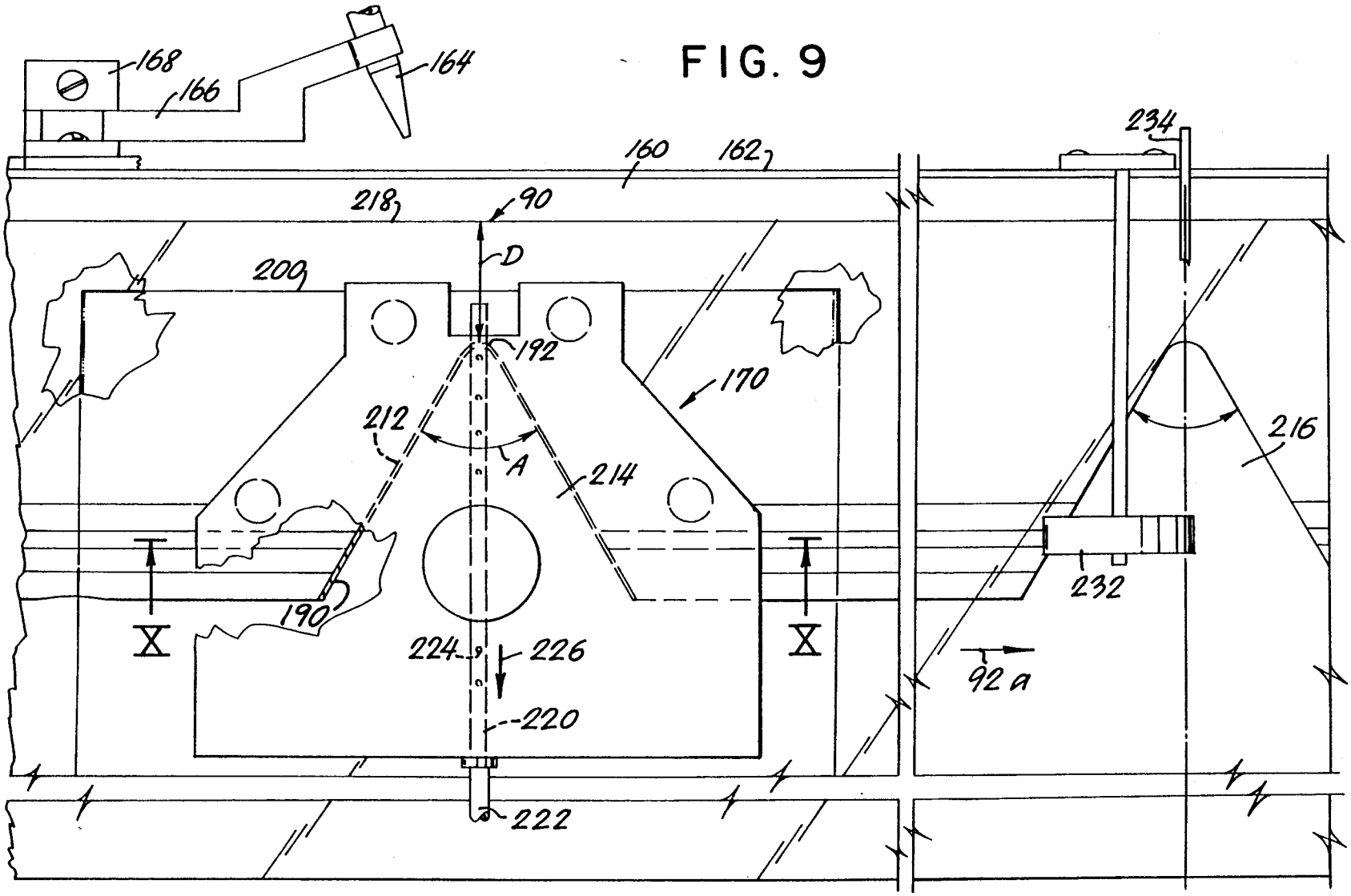
FIG. 9 is a top plan view partially diagrammatical, illustrating the cutting out of wedge shaped portions from the folded-over flap portion with the utilization of a template in accordance with the invention.
Figure 10:
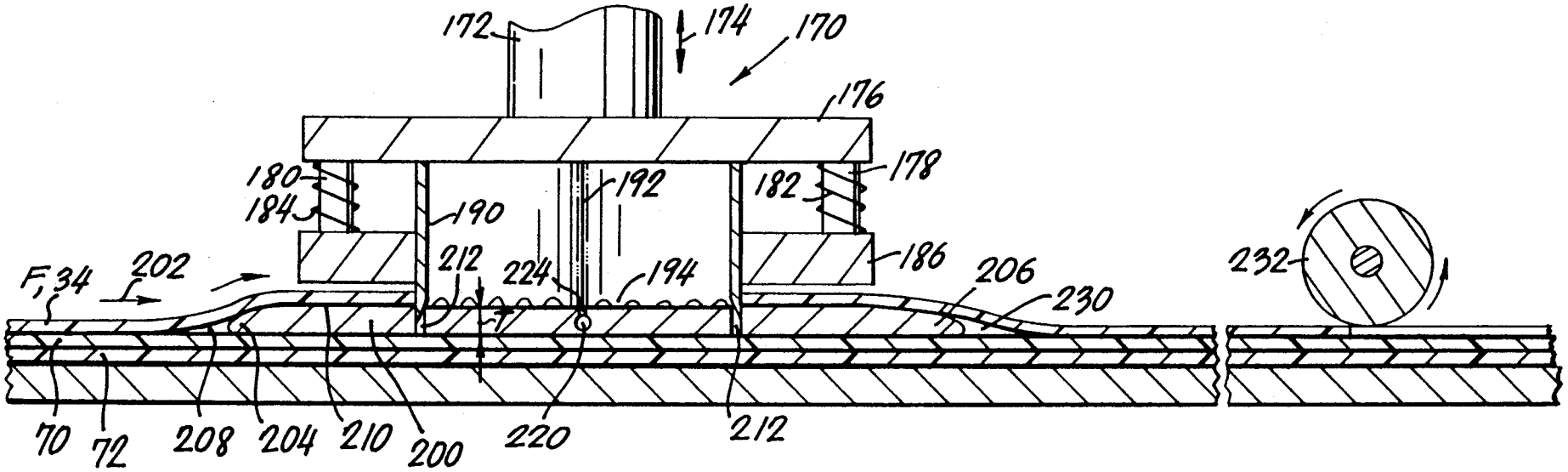
FIG. 10 is a side view, partially in section, illustrating the cutting out of wedge shaped notches by the use of a template and cutting tool in accordance with the invention.
Figure 11:
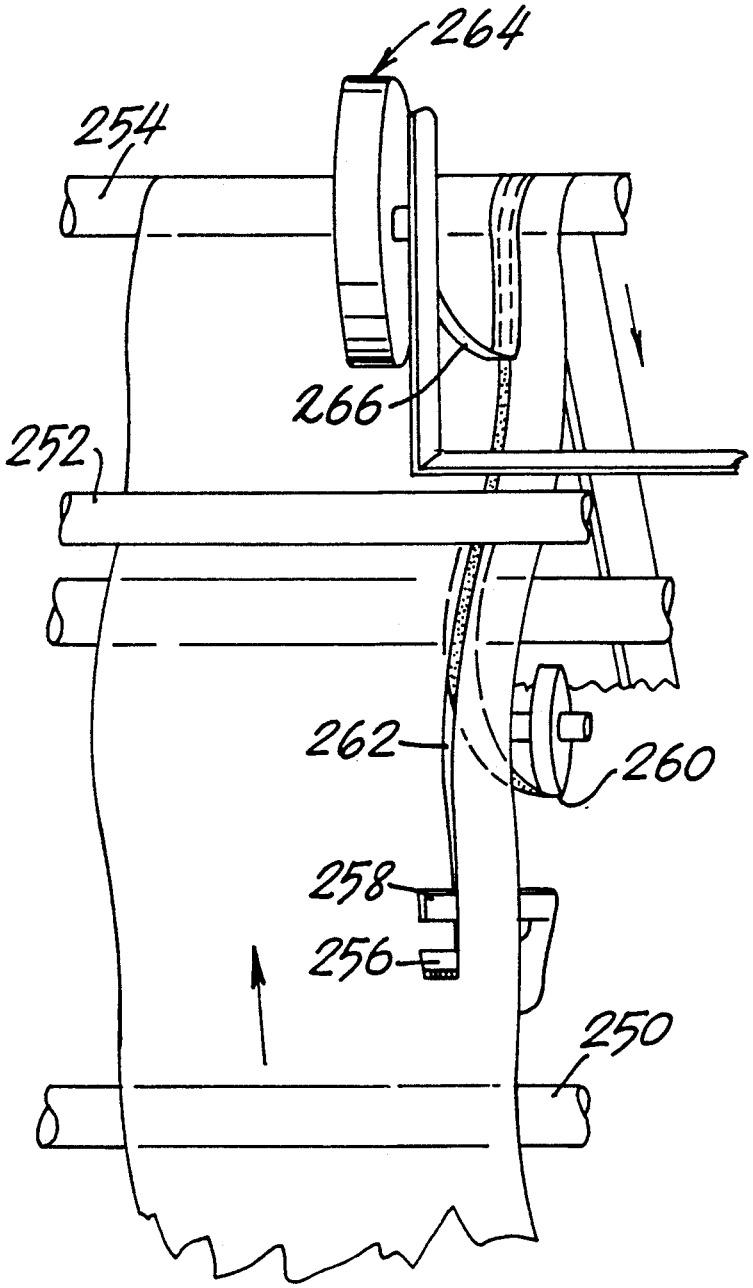

FIG. 9, which is further illustrated by FIG. 10, illustrates the notching and sealing stations of the apparatus and methods of the invention. Therein is illustrated the film strip arrangement 90 longitudinally displaced in the direction indicated by arrow 92 (*a*) indicating a continuation of the processing path referred to hereinabove with reference to FIG. 6. In this figure is illustrated a table 160 having an edge 162 and supporting an air jet nozzle 164 supported by an arm 166 affixed to the edge of the table by a clamping mechanism 168.

Also indicated in FIG. 9 is the cutting station 170 which also appears in FIG. 10. Forming part of the cutting station is a piston and cylinder arrangement of which the piston is indicated at 172. This piston is reciprocable as indicated by arrow 174. The piston bears on the lower free end thereof a plate 176 having thereon posts as indicated at 178 and 180. These posts bear springs 182 and 184 which spring load a plate 186 slidably displaceable on the posts 178 and 180. The sheet 186 supports a triangular knife 190 having its apex indicated at 192. This knife bears serrations forming a multiplicity of teeth indicated at 194.

An especially important part of the invention as relates to the method and apparatus thereof is the template which is employed. This template is indicated at 200. The function of the template is multifold. It provides for lifting the flap portion F, 34 away from the layer or film section 70, while at the same time accommodating the severing teeth of the cutting tool 190. The template also provides for blowing away the cut-out portions forming the notches which ultimately provide for the configuation of the flap portion 34 as illustrated in FIG. 1. To this end the template 200 is in its preferred form a rectangular sheet having a thickness T in the order of magnitude of about one eighth of an inch. The leading edge 204 of the template as regards the path of travel of the film strip arrangement being processed is indicated by arrow 202. The trailing edge appears at 206. The flap portion F, 34 moves away from film strip section 70 at 208 and proceeds over the upper surface of template 200, as indicated at 210. To enable the template to function properly, it is provided with a coating of a self-lubricating material such as Teflon. This Teflon permits the pressure-responsive adhesive to be separated readily and without destruction of the same.

With the flap portion F, 34 superposed above the upper surface 210 of template 200, the portion to be cut out is displaced to a position under the cutting tool 190. The template 200 accommodates penetration of the cutting teeth 194 of the cutting tool since the template is provided with a triangular grove indicated at 212. Thus the cutting teeth can penetrate below the upper surface 210 of the template thereby to remove a triangular-shaped notch as indicated at 214 and 216. More particularly, the cut-out portion and the notch itself are both symmetrical and preferably in the configuration of an isosceles triangle. The apex 192 of the cutting tool, and therefore of both the cut-away portion and the notch, is spaced from the edge 218 of the longitudinally displaced film arrangement by a distance indicated at D. This dimension determines the height of the rectangular portion 46 of the flap section 38, as illustrated in FIG. 1. This distance, which may be, for example, in the order of magnitude of one-quarter of an inch is variable within the scope of the invention and is subject to determination at will according to the requirements of the finished bag design. This latitude also applies to the shape and angle of the apex of the cut-away portion or notch, the cut-away portion preferably having, however, an apex angle lying within the range of from 15° to 60°. The apex angle is indicated at A.

To enable the removal of the cut-out portion formed by the reciprocation of the cutting tool into the above-described slot in template 200, the template is provided with a channel 220 to which is connected a source of compressed air as indicated at 222. From channel 220 extend a plurality of openings 224 which open through the upper surface 210 of the template and which are directed in inclined fashion in the direction of arrow 226. Air exiting through openings 224 serves to displace the cut-out portion from the remainder of the plastic film arrangement. This initial displacement is supplemented by a blast of air which is directed towards the cut-out portion by means of air jet nozzle 164. A vacuum arrangement (not shown) is furthermore provided which evacuates the sequential cut-out portions formed at the cutting station from the vicinity of the cutting station for purposes of disposal.

As the film arrangement continues along its path of processing, it descends over the trailing edge 206 of the template, as indicated at 230. It then passes beneath a roller 232 whereby the adhesive bond is restored and whereafter the arrangement with the cut-out notches 216 continues on its way to a sealing station diagrammatically indicated at 234. At this station is employed a conventional heated wire or sealing and cutting knife which is applied to the plastic arrangement transversely of the direction of movement thereof (and thus transversely of the path of processing). The sealing and cutting is arranged to bisect the cut-out notches 216 and to form laterally sealed edges in the resulting bags which are then in completed form. Printing operations may be effected at any desired stage along the processing path or prior thereto. An opening of the bottom edge of the respective bags will be automatically provided for if the initial film arrangement is constituted by two separate films which are brought into face-to-face relationship. As an alternative, the folded-over bottom edge, if such is employed, may be opened by means of a slitting arrangement.

In the aforegoing description, the arrangement of the cutting tool is such that the plate 180 is brought downwardly against the flap portion F, 34 for an instantaneous cutting operation. This operation takes place at a rate relative to the speed of travel of the film arrangement 90, such that little or no interference with the travel of the film arrangement occurs and such that the operation of downstream rollers, including the roller 232, may once again bring the film arrangement under tension, thereby to avoid distortion in the film arrangement 90.

In the aforegoing, reference is made to Scotch tape (or the equivalent) in general. By way of example, this Scotch tape may be a 0.002 inch thick Scotch tape with a 28 O.P.I. (ounces per inch) adhesive and with a tensile strength of 25. Such a tape is supplied by Devon Tape Corp. of North Bergen, N. J. through Norel Co. of North Bergen, N. J. as Norel 84ER. The tape substrate can be polypropylene or polyethylene and the adhesive can be, for example, acrylic or gum adhesive.

As has been noted above, relative to FIGS. 1 and 4, for example, the bag may have a closable upper end which is closed by the improved flap of the invention or the like, and a lower end 24 which may remain open to enable goods to be loaded into the bag via the lower end. In this arrangement, the upper end is provided to the manufacturer or packager of the goods with the upper end closed and with the lower end opened. After the goods are loaded into the bag, the lower end may be sealed in a number of ways such as, for example, by heat sealing since the bag is made of a material readily suited for this purpose. After the lower end of the bag is sealed, access to the goods is afforded by pealing back the flap from the upper end and opening the mouth of the bag to enable the goods to be unloaded through the thusly opened mouth. It will be understood that the open lower end 24 is exemplary only of the number of zones through which loading may take place, although the utilization of the open lower end greatly facilitates manufacture of the bag itself.

There will now be obvious to those skilled in the art many modifications and variations of the article of manufacture, disclosed hereinabove. These modifications and variations will not depart from the scope of the invention if defined by the following claims.

What is claimed is:

1. An article of manufacture comprising a bag provided with a mouth, a first flap section of generally rectangular shape on said bag at said mouth to close the same, a generally trapezoidal second flap section in extension of but separate from said first flap section, at least one of said sections defining a gap, and adhesive means spanning and exposed through said gap, said bag and flap sections being of plastic film, said bag being of first and second films of corresponding widths and having lateral edges, said first flap section corresponding in width to said first and second films and having lateral edges corresponding to the lateral edges of the first and second films, the corresponding lateral edges of the first and second films and the first flap section being connected together, said adhesive means providing for detachable attachment of at least one of the flap sections to the second film, the second flap section having sloped lateral edges sloping away from the lateral edges of the first and second films, said bag having a generally ink receptive outer surface except for a portion corresponding generally to the adhesive means exposed through said gap, said portion providing for ready detachment and reattachment of the adhesive means thereat, said sloped lateral edges being formed while the second flap section is temporarily elevated from said second film.

2. An article of manufacture as claimed in claim 1 wherein said flap sections are connected and substantially coplanar.

3. An article of manufacture as claimed in claim 2 wherein said first flap section is hingedly connected to said first film.

4. An article of manufacture as claimed in claim 1 wherein said films are polyethylene or polypropylene and said adhesive means is a pressure-responsive adhesive means.

5. An article of manufacture as claimed in claim 4, wherein said adhesive means includes a tape having a face on which an adhesive is supported, said tape spanning said gap and being bonded by said adhesive to said flap sections.

6. An article of manufacture as claimed in claim 5 wherein said gap is of at least substantially constant breadth and is located in entirety in said second flap section.

7. An article of manfacture as claimed in claim 6 wherein the tape is a Scotch tape.

8. An article of manfacture as claimed in claim 7, wherein said gap is of a breadth of about 0.030 to 1.00 inches.

9. An article of manfacture as claimed in claim 1 wherein one of said flap sections includes indicia thereon to distinguish the second flap section and to indicate to a user where the second flap section and adhesive means can be lifted from the bag.

10. An article of manufacture as claimed in claim 1, wherein the bag has two spaced extremities, one of which is said mouth and the other of which is initially open for purposes of filing.

11. An article of manufacture as claimed in claim 1 wherein the outer surface is ozone treated except at said portion.

* * * * *